US007441644B2

(12) United States Patent
Aulanko et al.

(10) Patent No.: US 7,441,644 B2
(45) Date of Patent: Oct. 28, 2008

(54) TRAVELATOR, MOVING RAMP OR ESCALATOR

(75) Inventors: Esko Aulanko, Kerava (FI); Jorma Mustalahti, Hyvinkää (FI); Marc Ossendorf, Bochum (DE)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 11/491,496

(22) Filed: Jul. 24, 2006

(65) Prior Publication Data

US 2007/0175731 A1 Aug. 2, 2007

Related U.S. Application Data

(63) Continuation of application No. PCT/FI2005/000013, filed on Jan. 12, 2005.

(30) Foreign Application Priority Data

Jan. 22, 2004 (FI) ..... 20040090

(51) Int. Cl.
*B66B 23/22* (2006.01)

(52) U.S. Cl. ..... 198/335; 198/338

(58) Field of Classification Search ..... 198/335, 198/336, 337, 338
See application file for complete search history.

(56) References Cited

U.S. PATENT DOCUMENTS 1,941,498 A * 1/1934 Shonnard ..... 198/335
2,766,868 A * 10/1956 Tilton ..... 198/337
3,321,059 A * 5/1967 Kroepel ..... 198/335
3,353,650 A * 11/1967 Schroeder et al. ..... 198/335
3,568,813 A * 3/1971 Schaeffer et al. ..... 198/335
3,749,224 A * 7/1973 Engeler ..... 198/331
3,835,977 A * 9/1974 Hewitt et al. ..... 198/323
3,981,118 A * 9/1976 Johnson et al. ..... 52/716.8
4,159,758 A * 7/1979 Courson ..... 198/335
4,232,776 A * 11/1980 Dean ..... 198/322
4,646,907 A * 3/1987 Streibig et al. ..... 198/335
4,662,502 A * 5/1987 Nakatani ..... 198/328
4,953,686 A * 9/1990 Rulke ..... 198/332

(Continued)

FOREIGN PATENT DOCUMENTS

EP 0661230 A 7/1995

(Continued)

*Primary Examiner*—Mark A Deuble
(74) *Attorney, Agent, or Firm*—Venable LLP; Robert Kinberg

(57) ABSTRACT

An apparatus for transporting passengers in a transport direction such as, for example, a travelator, moving ramp, or escalator, is provided. The apparatus includes a conveyor mounted on a first frame adapted to be supported on a fixed structure. The first frame includes two elongated first frame parts which include guide tracks for guiding the conveyor. The first frame parts may be profiled metallic bodies of solid material joined together end to end one after the other. The profiled metallic bodies include one or more extruded profiles. A handrail is provided and includes a handrail frame and an endless handrail belt mounted on the handrail frame. The endless handrail belt is arranged as a loop having an upper handhold portion that a passenger can grip with a hand for support and a lower return portion disposed inside the first frame. A number of suspenders are fastened to the first frame at a distance from each other to support the return portion of the handrail belt inside the profiled metallic bodies.

12 Claims, 4 Drawing Sheets

U.S. PATENT DOCUMENTS

| | | | | | |
|---|---|---|---|---|---|
| 5,180,047 | A | * | 1/1993 | Barrett et al. | 198/335 |
| 5,215,177 | A | * | 6/1993 | Johnson et al. | 198/335 |
| 5,458,220 | A | * | 10/1995 | Nguyen et al. | 198/335 |
| 5,496,086 | A | * | 3/1996 | Adrian et al. | 294/65 |
| 5,542,522 | A | * | 8/1996 | Adrian et al. | 198/337 |
| 5,601,179 | A | * | 2/1997 | Wente et al. | 198/335 |
| 5,782,333 | A | * | 7/1998 | Pitts | 198/336 |
| 5,881,859 | A | * | 3/1999 | Bianchi | 198/335 |
| 5,971,137 | A | | 10/1999 | Grant et al. | |
| 6,223,879 | B1 | * | 5/2001 | Schops | 198/321 |
| 6,374,981 | B1 | | 4/2002 | Gschwendtner et al. | |
| 7,063,203 | B2 | * | 6/2006 | Gonzalez Alemany et al. | 198/334 |
| 7,243,775 | B2 | * | 7/2007 | Novacek et al. | 198/337 |
| 2002/0175039 | A1 | | 11/2002 | Fargo et al. | |

FOREIGN PATENT DOCUMENTS

| | | |
|---|---|---|
| GB | 2 213 122 | 8/1989 |
| JP | 11310378 | 11/1999 |
| JP | 2000-211871 | 8/2000 |
| JP | 2003212467 | 7/2003 |

* cited by examiner

TRAVELATOR, MOVING RAMP OR ESCALATOR

CROSS-REFERENCE TO RELATED APPLICATIONS

This application is a continuation of International Application No. PCT/FI2005/000013 filed Jan. 12, 2005, designating the United States and claiming priority from Application No. FI20040090 filed in Finland on Jan. 22, 2004, the disclosures of both applications being incorporated herein by reference along with each and every U.S. and foreign patent and patent application mentioned herein below. The subject matter of this application is related to commonly owned and concurrently filed U.S. patent application Ser. No. 11/491,495.

BACKGROUND OF THE INVENTION

The present invention relates to a travelator, moving ramp or escalator comprising a conveyor and a frame on which the conveyor is mounted.

In the prior art, a travelator, moving ramp or escalator is known whereby people are transported on a conveyor in a horizontal direction or at an upward/downward angle. The conveyor is mounted on a frame which is secured to a fixed structure, such as a floor in the case of a travelator, or to different floor levels in the case of a moving ramp or escalator. A handrail is provided at the side of the conveyor. The handrail comprises a handrail frame and an endless handrail belt supported on the handrail frame and arranged as a loop. A passenger on the conveyor can grip the upper handhold portion of the handrail belt for support. The lower return portion of the handrail belt is disposed inside the frame. The return portion of the handrail belt is usually guided by rollers supporting the handrail belt, so that a rolling contact exists between the rollers and the outer surface of the belt.

A problem with the known arrangement for guiding the return portion of the handrail belt is that the rollers cause wear of the outer surface of the belt, which even otherwise is exposed to wear. The problem is therefore a short service life of the handrail belt. The handrail belt is an expensive part that has to be replaced at regular intervals. In addition, the rollers take up plenty of space in the frame. The known solution for supporting the return portion is not suited for use in travelators, moving ramps or escalators that have a frame intended to be of as low a construction height as possible and that have been designed to be mounted on a fixed base without forming a pit in the fixed base.

SUMMARY OF THE INVENTION

An object of the present invention is to overcome the above-mentioned drawbacks.

A specific object of the invention is to provide a travelator, moving ramp or escalator in which the suspension of the return portion of the handrail belt is implemented in a manner as effective as possible in respect of cost and space utilization and so that it does not cause wear of the outer surface of the handrail belt.

A further object of the invention is to provide a travelator, moving ramp or escalator with a handrail belt having an extended service life.

An additional object of the invention is to provide a travelator, moving ramp or escalator in which guidance of the return portion of the handrail belt allows the use of a frame structure of as low a construction height as possible that is suited for installation upon a fixed base without requiring a pit to be made in the fixed base.

The above and other objects are accomplished according to the invention by the provision of in one exemplary embodiment of a travelator, moving ramp or escalator for transporting passengers, comprising: a conveyor; a first frame adapted to be supported on a fixed structure, the conveyor being mounted on the first frame, the first frame comprising two elongated first frame parts which include guide tracks for guiding the conveyor, the first frame parts comprising profiled metallic bodies of solid material joined together end to end one after the other, the profiled metallic bodies comprising one or more extruded profiles; a handrail comprising a handrail frame and an endless handrail belt mounted on the handrail frame and arranged as a loop having an upper handhold portion that a passenger can grip with a hand for support and a lower return portion disposed inside the first frame; and a number of suspenders fastened to the first frame at a distance from each other to support the return portion of the handrail belt inside the profiled metallic bodies.

The invention has the advantage that the suspender is inexpensive and allows the handrail belt guiding system to be accommodated in a small space in the first frame. As the handrail belt is supported by suspenders, its outer surface is not subjected to wear, the service life of the handrail belt being thus extended. Moreover, it is also possible to integrate other functions in the suspender.

In another embodiment of the invention, the handrail belt is in cross-section a substantially C-shaped profile, defining inside it an interior groove which in the return portion of the handrail belt opens upwards and which groove has at its edges edge flanges directed towards each other, with a gap between them; and that the suspender comprises a web extending through the gap of the handrail belt into the interior groove and suspension flanges extending on either side of the web under the edge flanges to support the handrail belt.

In a further embodiment of the invention, the suspender comprises one or more coupling elements for securing a conductor.

In another embodiment of the invention, the suspender is formed from a material that has a substantially low friction coefficient.

In yet another embodiment of the invention, the contact surfaces of the edge flanges of the handrail belt that come into contact with the suspension flanges are coated with a material that has a substantially low friction coefficient.

In a further embodiment of the invention, the first frame comprises two elongated frame parts provided with guide tracks for guiding the conveyor and consisting of mutually identical profiled metallic bodies joined together end to end one after the other, which profiled metallic bodies contain coupling, supporting and/or guide elements integrated in one profiled metallic body of solid material; and a number of transverse cross members extending transversely between the frame parts to hold them parallel to each other at a distance from each other.

In another embodiment of the invention, the profiled metallic body consists of one or more profiles extruded from a light alloy, such as aluminum or an aluminum alloy.

In yet a further embodiment of the invention, the conveyor is a pallet conveyor comprising a number of successive pallets and a drive element, such as a link chain or belt, to which the pallets are connected to move the pallets, the drive element being arranged as an endless loop having an upper portion and a lower portion.

In another embodiment of the invention, one profiled metallic body of continuous material contains one or more items of the following group integrated in it:

a wall forming the outwardly visible outer surface of the frame part, a bottom fitted to be resting against a fixed base, first stop faces for forming a guide surface for supporting and guiding the pallets, second stop faces, against which the handrail frame can be supported, a mounting slot for a fastening element for securing the handrail frame, a first coupling element for securing the suspender, a second coupling element for coupling a second profiled body, such as a profiled body forming an interior wall, from a lateral direction, a first space, which has been fitted to receive inside it the return portion of the handrail belt, a second space, which has been fitted to receive inside it the upper portion of the drive element, a third space, which has been fitted to receive inside it the lower portion of the drive element, a fourth space, which has been fitted to receive inside it an extension joint element for joining the profiled metallic bodies end to end one after the other, and/or a fifth space, which has been fitted to receive inside it an alignment pin for butt alignment of the profiled metallic bodies.

In another embodiment of the invention, the travelator, moving ramp or escalator is a travelator, moving ramp or escalator of low construction height designed to be mounted on a fixed base, such as a floor or other support.

BRIEF DESCRIPTION OF THE DRAWINGS

In the following, the invention will be described in detail with reference to an exemplary embodiment and the attached drawing, wherein.

DETAILED DESCRIPTION OF THE EXEMPLARY EMBODIMENTS

Figure 1:
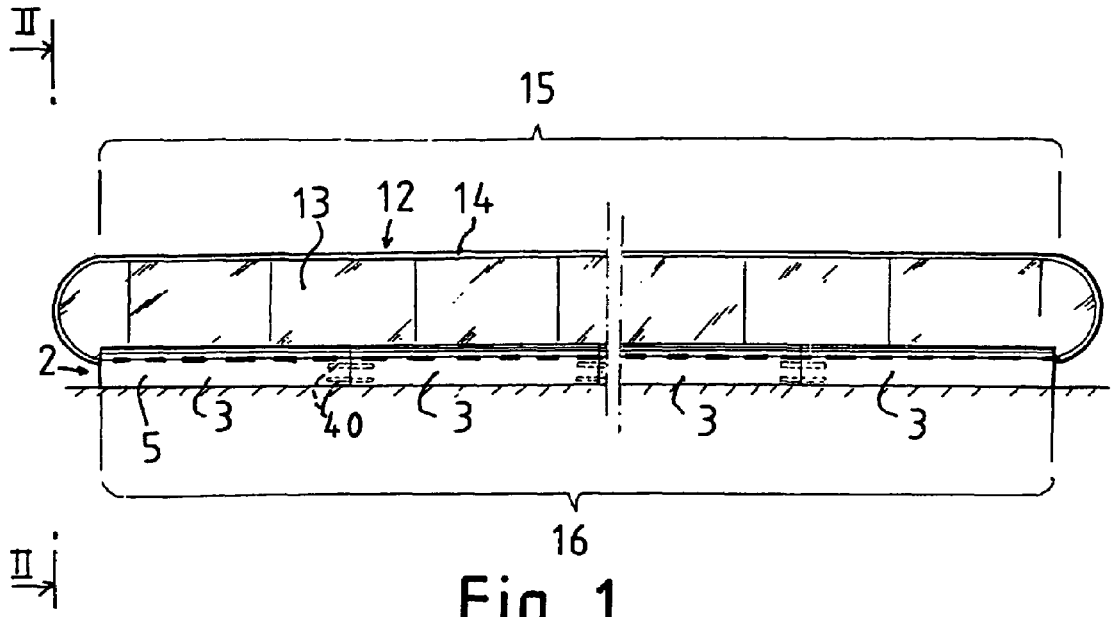
FIG. 1 shows a diagrammatic side view of an embodiment of the travelator of the invention.
Figure 2:
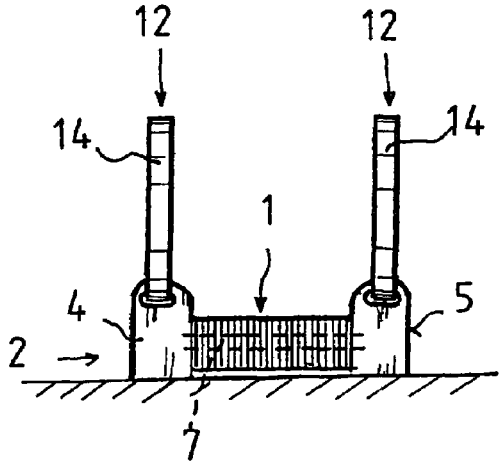
FIG. 2 shows the travelator of FIG. 1 as seen from direction II-II.

FIGS. 1 and 2 present a travelator of low construction height, designed to be mounted on a fixed base, such as a floor or other support, which means that no pit needs to be made in the fixed base for the travelator machinery. In the following description of an example, the invention is described with reference to a horizontal travelator, but it is obvious that corresponding principles of the invention can also be applied to moving ramps and escalators.

The travelator comprises a conveyor 1, which may be, example, a pallet conveyor or a belt conveyor, which is supported on a frame 2. The entire length of the frame 2 rests on a floor base. As shown in FIG. 2, the frame 2 comprises two elongated frame parts 4, 5, which are connected together by a number of transverse cross members 7 extending transversely between the frame parts 4, 5 to hold them parallel to each other at a distance from each other. The frame parts 4, 5 are composed of mutually identical profiled metallic bodies 3 joined together end to end one after the other, which contain guide elements 6 integrated in one profile of solid material for guiding the coupling, supporting and/or moving parts of the conveyor, as will be described later on with reference to FIGS. 3 and 4.

As is further shown in FIGS. 1 and 2, the travelator comprises two handrails 12, one on either side of the conveyor 1. The handrails 12 comprise a handrail frame 13, which is secured to the profiled metallic bodies 3 serving as frame parts 4, 5. Mounted on the handrail frame 13 is an endless handrail belt 14, which has been arranged as a loop having an upper handhold portion 15 that the passenger can grip with a hand for support and a lower return portion 16 disposed inside the frame part 4, 5.

Figure 3:
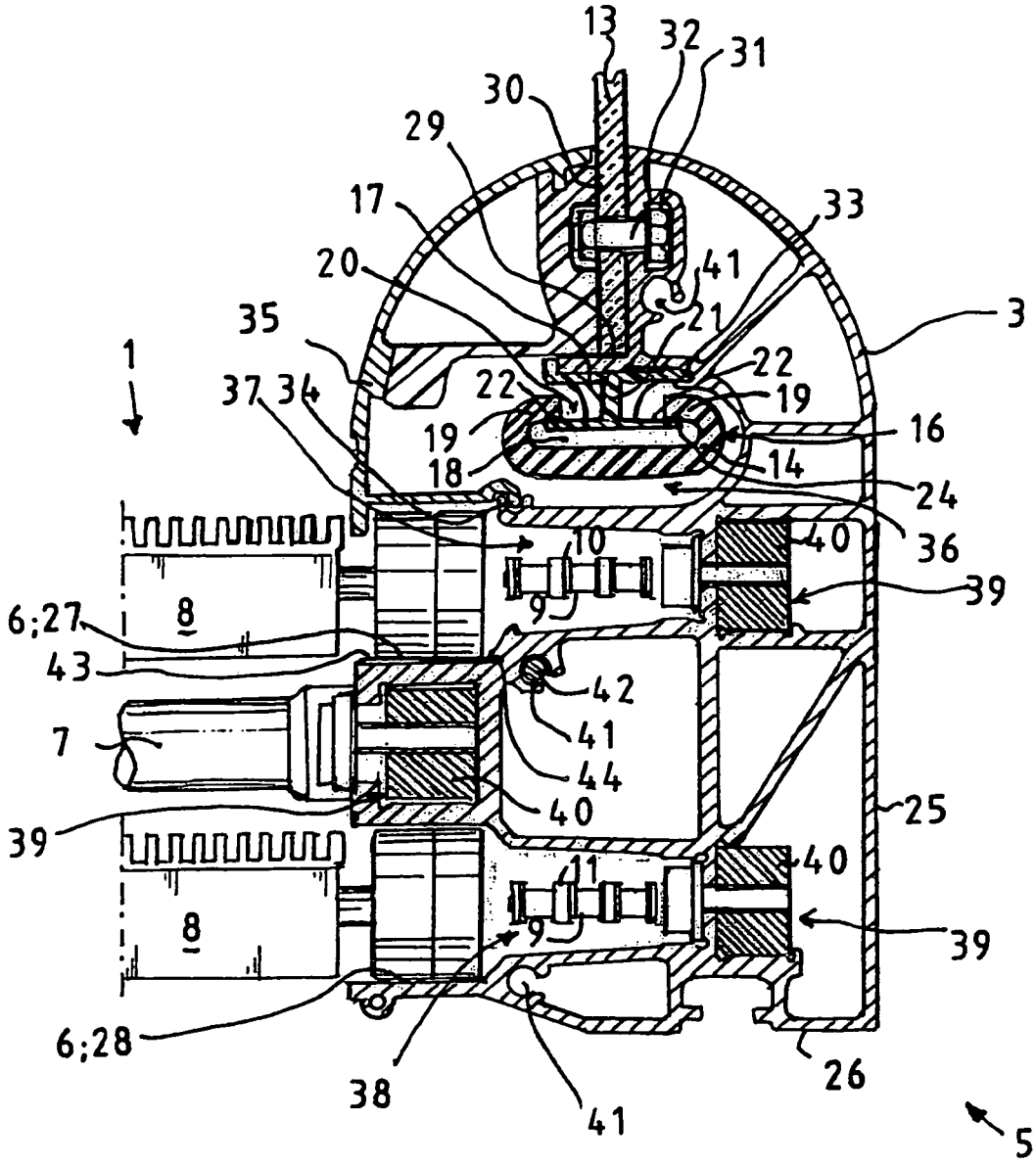
FIG. 3 shows a cross-sectional view of a part of the travelator in FIG. 1.

FIG. 3 is a diagrammatic view of one side of the conveyor 1. The other side, which is not shown in the figures, is identical but reversed like a mirror image. It can be seen from the figure that the conveyor 1 is a pallet conveyor comprising a number of pallets 8 arranged one after the other. In this case, the drive element 9 used to move the pallets is a link chain, to which the pallets 8 are secured to move them. The drive element 9 has been implemented as an endless loop, which extends perpendicularly to the plane of the figure and of which the figure shows the upper portion 10 and the lower portion 11. The pallet 8 shown at a higher level is a pallet moving in the transport direction. The pallet 8 shown at a lower level is a pallet moving in the opposite direction, returning to the beginning of the conveyor track.

The profiled metallic body 3, of which the frame parts 4 and 5 are composed, consists of a profile extruded from a light metal, preferably aluminum or an aluminum alloy, containing many functions integrated in one body.

As shown in FIG. 3, the handrail belt 14 is supported by suspenders 17, one of which is seen in the figure, which are fastened to the profiled metallic body 3 at a distance from each other to support the return portion 16 of the handrail belt 14. The handrail belt 14 is a substantially C-shaped profile in cross-section such that it defines inside it an interior groove 18 which, in the return portion 16 of the handrail belt, opens upwards. At the edges of the interior groove 18 are edge flanges 19 directed towards each other, with a gap 20 between them.

It can be seen from the FIG. 3 that the web 21 of the suspender 17 extends through the gap 20 of the handrail belt into the interior groove 18. The suspension flanges 22 extend under the edge flanges 24 on either side of the web 21, thus supporting the handrail belt 14.

Figure 5:
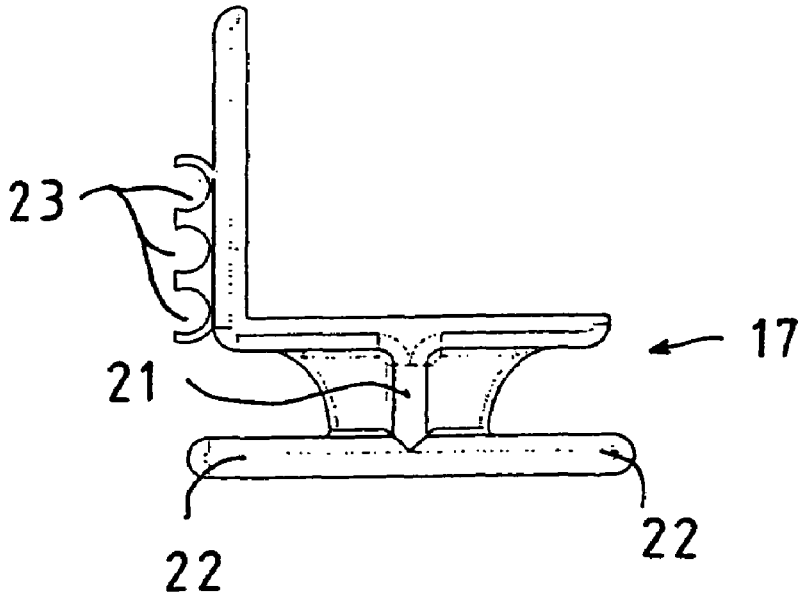
FIG. 5 shows a suspender that can be joined to the profile of the frame part 3 in FIG. 3.
Figure 6:
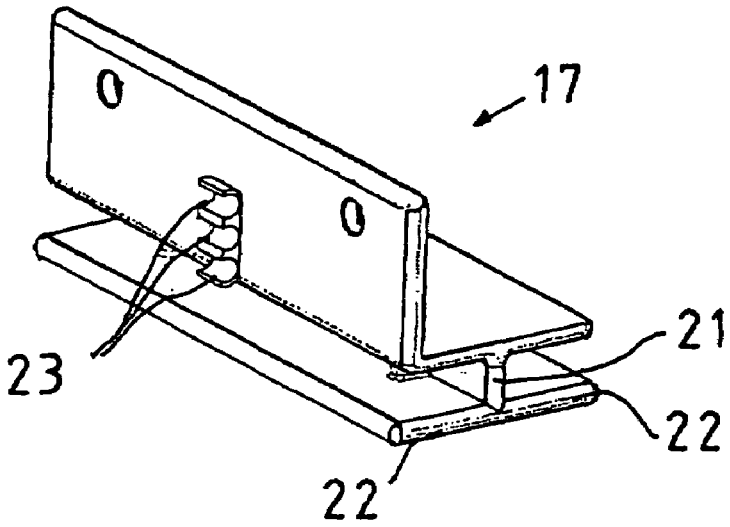
FIG. 6 shows an axonometric view of the suspender in FIG. 5.

From FIGS. 5 and 6 we can see that the suspender 17 comprises a vertical mounting flange whereby the suspender 17 can be fastened with a screw joint to the profiled body 3. The mounting flange has three snap-on coupling elements 23 formed on it for the attachment of conductors. The suspender 17 is preferably a single solid piece extruded from plastic. To allow the handrail belt to slide with low friction on the suspenders, the suspender 17 is formed from a plastic material having a substantially low friction coefficient. Similarly, the contact surfaces 24 of the edge flanges 19 of the handrail belt 14 that come into contact with the suspension flanges 22 may be coated with a material having a substantially low friction coefficient.

Figure 4:
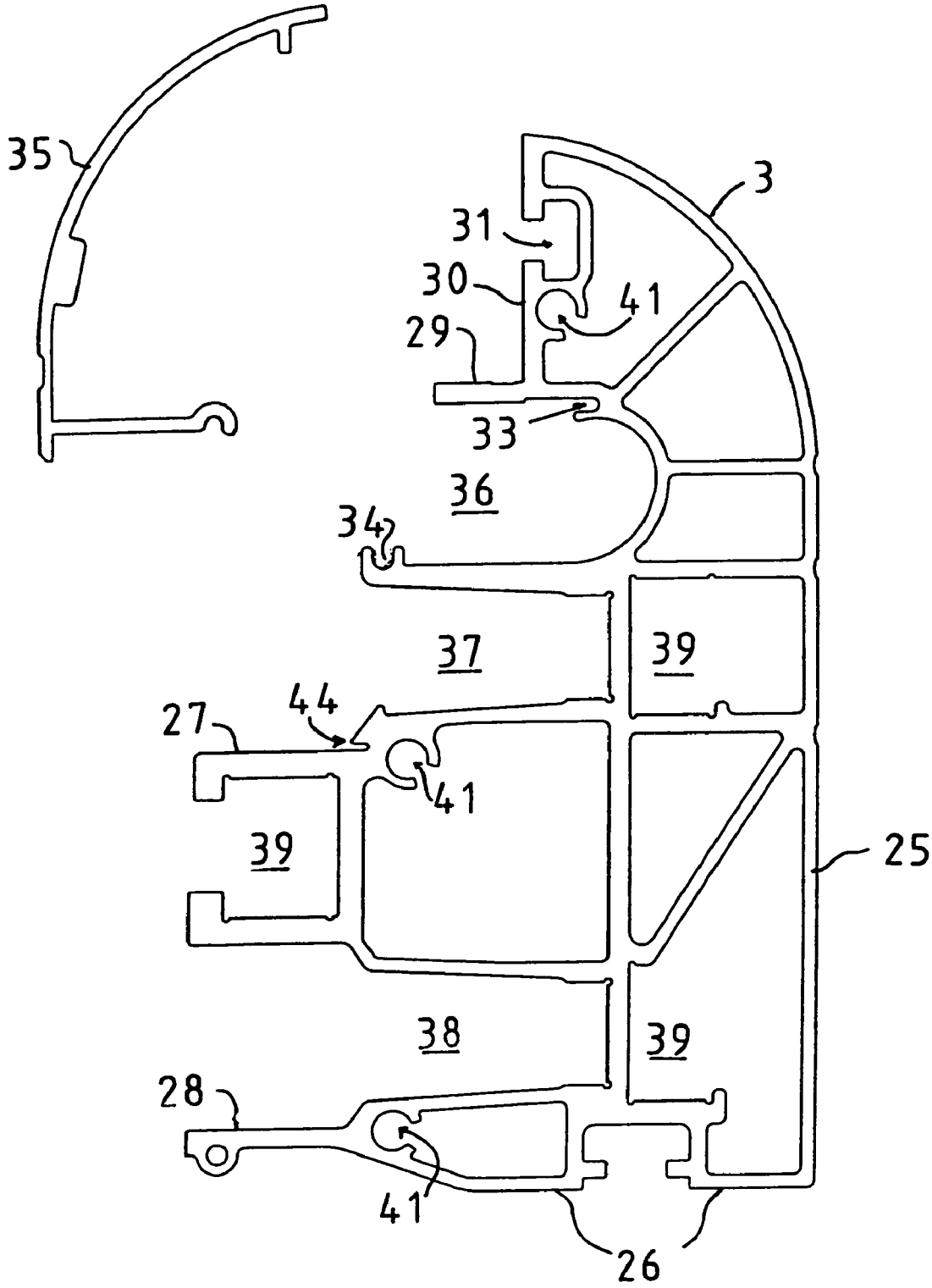
FIG. 4 shows the profile of the frame part in FIG. 3 and a covering profile that can be attached to it.

As can be seen from FIGS. 3 and 4, integrated in the single profiled metallic body of solid material is a wall 25 forming the outwardly visible outer surface of the frame part 4, 5 and a bottom 26 fitted to be resting against a fixed base. Further, the profiled body 3 has first stop faces 27, 28 for forming a guide track 6 for supporting and guiding the pallets 8. The upper stop face 27 supports the wheels of loaded pallets 8. The whole or part of the length of the upper stop face 27 can be covered with a wearing plate 43, such as a sheet steel plate, which can be fastened in place in a groove 44 formed in the profiled metallic body. Such a sheet steel plate 43 is preferably provided at least at the joints between profiled metallic bodies 3 to eliminate any discontinuities of the stop face that may arise due to inaccurate alignment. Further, integrated in the profiled metallic body 3 are second stop faces 29, 30, which are a horizontal stop face 29, on which the edge of the handrail frame plate 13 can be supported, and a vertical stop face 30, against which the edge of the handrail frame plate 13 can be rested. Formed in the profiled body 3 is also a mounting slot 31 for a retaining bolt 32 used to secure the handrail frame 13, which slot can receive the head of the bolt 32 inside it. The profiled metallic body 3 further has a groove integrated in it as a coupling element 33 for fastening the suspender 17. In addition, it has a second coupling element 34 for joining a second profiled body 35 forming an interior wall to the profiled metallic body 3 from a lateral direction. Further, the profiled metallic body 3 contains a first space 36, which has been fitted to receive the return portion 16 of the handrail belt 14 inside it. Moreover, the profiled metallic body 3 contains a second space 37, which has been fitted to receive the upper portion 10 of the drive element 9 inside it. A third space 38 has been fitted to receive the lower portion 11 of the drive element 9 inside it. Furthermore, the profiled metallic body 3 contains three fourth spaces 39, which have been fitted to receive inside them a bar-like extension joint element 40 for joining the profiled metallic bodies 3 end to end one after the other. In addition, the profiled metallic body 3 contains three fifth spaces 41, which have been fitted to receive inside them round alignment pins 42, by means of which the profiled metallic bodies 3 can be accurately aligned relative to each other.

The invention is not limited to the embodiment examples described above; instead, many variations are possible within the scope of the inventive concept defined in the claims.

What is claimed is:

1. An apparatus for transporting passengers in a transport direction, comprising:

a conveyor;

a frame adapted to be supported on a fixed structure, the conveyor being mounted on the frame, the frame comprising two elongated frame parts each including guide tracks for guiding the conveyor, wherein each of the two elongated frame parts comprises a plurality of profiled metallic bodies of solid material joined together end to end one after the other, and wherein each of the profiled metallic bodies comprises one or more extruded profiles;

a handrail comprising a handrail frame and an endless handrail belt mounted on the handrail frame, wherein the handrail belt is arranged as a loop having an upper handhold portion that a passenger can grip with a hand for support and a lower return portion disposed inside the plurality of profiled metallic bodies; and a number of suspenders fastened to the profiled metallic bodies at a distance from each other in the transport direction to support the return portion of the handrail belt inside the profiled metallic bodies.

2. The apparatus according to claim 1, wherein the handrail has a cross-section that is a substantially C-shaped profile with an interior groove which in the return portion of the handrail belt opens upwards and which has at its edges edge flanges directed towards each other, with a gap between the edge flanges; and wherein each of the number of suspenders comprises:

a web extending through the gap of the handrail belt into the interior groove; and suspension flanges extending on either side of the web under the edge flanges to support the handrail belt.

3. The apparatus according to claim 2, wherein each of the number of suspenders comprises one or more coupling elements for securing a conductor.

4. The apparatus according to claim 1, wherein each of the number of suspenders comprises a material having a substantially low friction coefficient.

5. The apparatus according to claim 2, wherein the edge flanges of the handrail belt have contact surfaces that come into contact with the suspension flanges, wherein the contact surfaces are coated with a material having a substantially low friction coefficient.

6. The apparatus according to claim 1, wherein each of the profiled metallic bodies joined together end to end one after the other are mutually identical, and wherein the frame further includes a number of transverse cross members extending transversely between the two elongated frame parts to hold the frame parts parallel to each other at a distance from each other.

7. The apparatus according to claim 1, wherein each of the one or more extruded profiles are extruded from a light metal.

8. The apparatus according to claim 7, wherein the light metal comprises one of aluminum or an aluminum alloy.

9. The apparatus according to claim 1, wherein the conveyor comprises:

a pallet conveyor including a number of successive pallets; and a drive element arranged as an endless loop having an upper portion and a lower portion.

10. The apparatus according to claim 9, wherein the drive element comprises one of a link chain or belt to which the pallets are connected to move the pallets.

11. The apparatus according to claim 9, wherein each profiled metallic body of solid material includes one or more of the following integrated features:

a wall forming an outwardly visible outer surface of the frame part;

a bottom adapted to rest against the fixed structure;

first stop faces for forming the guide track for supporting and guiding pallets;

second stop faces against which the handrail frame can be supported;

a mounting slot for a fastening element for securing the handrail frame to the profiled metallic body;

a first coupling element for securing at least one of the number of suspenders to the profiled metallic body;

a second coupling element for joining a second profiled body from a lateral direction to the profiled metallic body;

a third coupling element for fastening a wearing plate on an upper stop face of the first stop faces;

a first space adapted to receive the return portion of the handrail belt;

a second space adapted to receive the upper portion of the drive element;

a third space adapted to receive the lower portion of the drive element;

a fourth space adapted to receive an extension joint element for joining the profiled metallic body end to end with another of the profiled metallic bodies;

a fifth space adapted to receive an alignment pin for butt alignment of each of the profiled metallic bodies relative to each other adjacent profiled metallic body.

12. The apparatus according to claim 1, wherein the apparatus has a low construction height adapted to be mounted upon the fixed structure including one of a floor or other support.

* * * * *